US008366394B1

(12) United States Patent
Liang

(10) Patent No.: US 8,366,394 B1
(45) Date of Patent: Feb. 5, 2013

(54) TURBINE BLADE WITH TIP RAIL COOLING CHANNEL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 366 days.

(21) Appl. No.: 12/909,403

(22) Filed: Oct. 21, 2010

(51) Int. Cl.
*F01D 5/08* (2006.01)

(52) U.S. Cl. ..... 416/97 R; 415/115

(58) Field of Classification Search ..... 415/115, 415/116, 173.1; 416/96 R, 97 R
See application file for complete search history.

(56) References Cited

U.S. PATENT DOCUMENTS

| | | | | |
|---|---|---|---|---|
| 3,658,439 | A * | 4/1972 | Kydd | 416/97 R |
| 4,259,037 | A * | 3/1981 | Anderson | 416/96 R |
| 7,246,653 | B2 * | 7/2007 | Judet | 164/516 |
| 8,182,221 | B1 * | 5/2012 | Liang | 416/1 |

* cited by examiner

*Primary Examiner* — Dwayne J White
(74) *Attorney, Agent, or Firm* — John Ryznic

(57) ABSTRACT

A turbine rotor blade with a main spar and a thin thermal skin bonded to form an airfoil surface for the blade. The blade includes radial extending cooling channels formed on the pressure side and suction side walls between the spar and the thermal skin. The P/S radial channels connect to a P/S tip cooling channel and the S/S radial channels connect to a S/S tip cooling channel. The tip cooling channels are connected to tip floor cooling channels that discharge into a cooling air collection cavity formed within the spar. A row of exit holes in the trailing edge are connected to the cooling air collection cavity.

14 Claims, 3 Drawing Sheets

TURBINE BLADE WITH TIP RAIL COOLING CHANNEL

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with tip rail cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Turbine blades and vanes make use of combinations of impingement cooling, convection cooling and film cooling to provide cooling and protection from the hot gas stream passing through the turbine. Airfoils with thin airfoil walls can be cooled better than an airfoil with a relatively thick wall because the heat transfer rate through a thin wall is greater than through a thick wall. However, modern turbine blades and vanes are produced using the lost wax or investment casting process in which a mold with a ceramic core is used to form the cooling passages within the metal piece. However, thin walls cannot be formed using the lost wax or investment casting process.

Another problem with turbine rotor blades is the hot gas leakage across the blade tip gap. Because the blade is exposed to different temperatures during engine operation such as a cold state at startup and a hot state at the steady state operation, the blade thermally expands and therefore the tip gap distance will change. The tip gap allows for hot gas leakage to flow between the blade tip and the blade outer air seal or BOAS. This hot gas leakage flow will create excess temperatures for the blade tips and the tip edges if not adequately cooling is available. The resulting hot spots will cause erosion damage that will shorten the blade useful life and decrease the efficiency of the turbine.

BRIEF SUMMARY OF THE INVENTION

A turbine rotor blade with a spar having an airfoil shape with radial cooling channels formed on the pressure side and the suction side, and a thin thermal skin bonded over the airfoil section of the spar to enclose the radial channels and form radial cooling passages for near wall cooling. The radial channels in the airfoil walls discharge into chordwise tip cooling channels formed on the pressure side wall and the suction side wall just under the tip crowns that form a squealer pocket. The tip cooling channels are connected to film cooling holes on both sides to discharge cooling air, and are connected to tip floor cooling channels to provide cooling for the tip floor before discharging the tip floor cooling air into a common cooling air collection cavity formed within the spar and then through a row of exit holes or slots formed on the trailing edge of the blade.

DETAILED DESCRIPTION OF THE INVENTION

Figure 1:
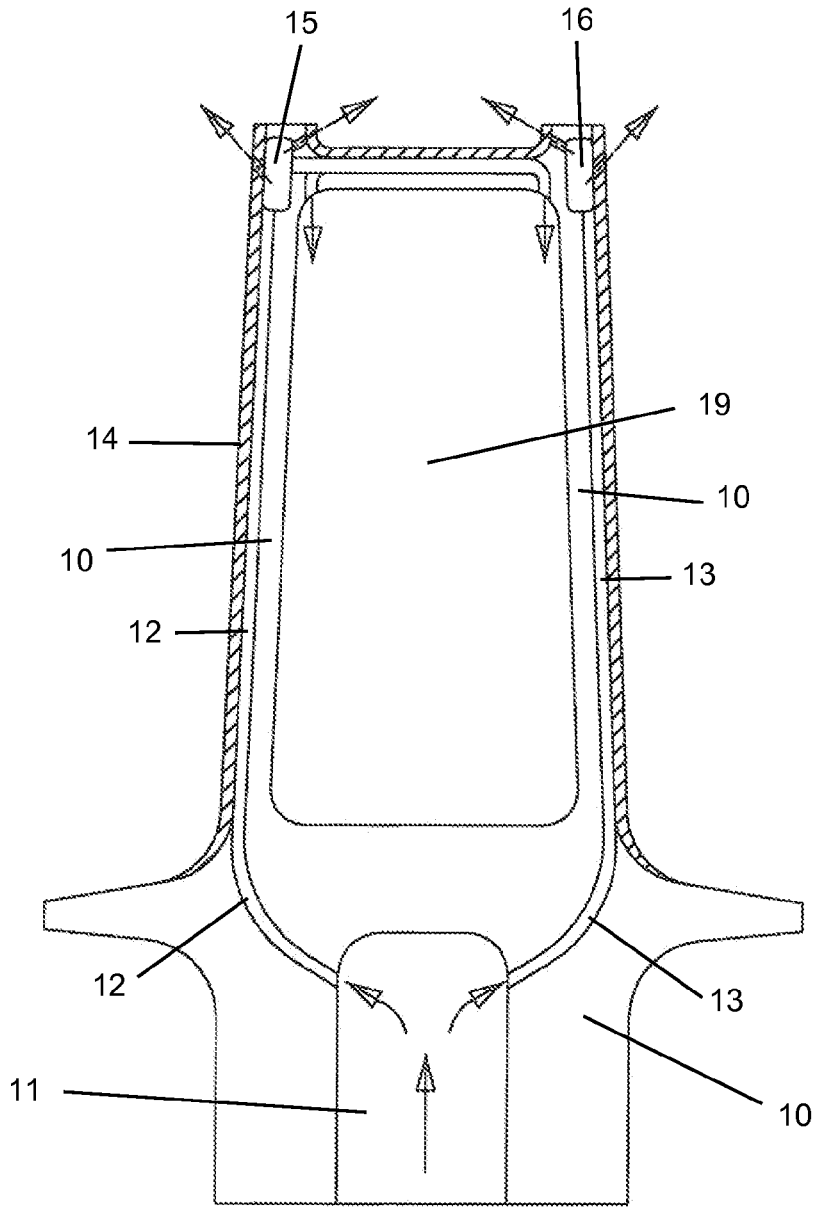
FIG. 1 shows a cross section view of the blade of the present invention with pressure side wall and suction side wall cooling features.

The turbine rotor blade is shown in various forms in FIGS. 1 through 4. In FIG. 1, the blade is formed from a thin thermal skin 14 bonded over a spar 10 that has an airfoil shape with a leading edge and a trailing edge with a pressure side wall and a suction side wall extending between the two edges. The thin thermal skin can be made of a different material than the spar such as a high temperature resistant metal like a refractory metal (Tungsten, Molybdenum, or Columbium). The spar 10 includes a root with a cooling air supply cavity 11 and a platform.

The spar 10 includes radial extending cooling channels 12 on the pressure side wall and channels 13 on the suction side wall that are open channels until the thin thermal skin 14 is bonded over the spar to enclose the channels and form radial extending cooling passages. The spar 10 also formed a cooling air collection cavity 19 to be described further below. The radial cooling channels and passages are connected to the cooling supply cavity 11 formed within the root of the spar 10.

The spar 10 and thin thermal skin 14 also form two tip cooling channels formed on the pressure side wall and the suction side wall that are connected to the respective radial cooling passages. The pressure side tip cooling channel 15 extends along the peripheral edge of the blade on the pressure side wall just underneath a P/S tip rail and is shown in detail in FIG. 2. The suction side tip cooling channel 16 extends along the peripheral edge of the blade on the suction side wall just underneath a S/S tip rail and is shown in detail in FIG. 3. A thin thermal skin 25 is also bonded to the tip of the spar to line the squealer pocket floor and tip rail sides. The radial extending cooling channels 12 and 13 on the P/S and S/S walls are directed to discharge the cooling air into the tip edge cooling channels 15 and 16 to produce impingement cooling on the tip rails.

Figure 2:
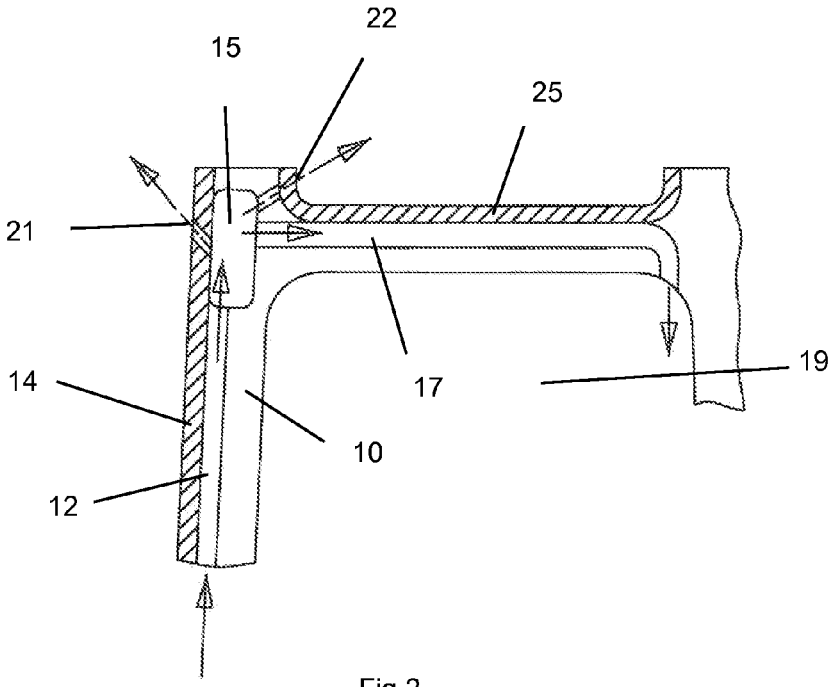
FIG. 2 shows a close-up view of the pressure side tip cooling circuit of FIG. 1.

The pressure side tip cooling channel 15 in FIG. 2 is connected to the P/S radial cooling channels 12 and to a series of first tip floor cooling channels 17 that discharge into the cooling air collection cavity 19. Film cooling holes 21 are also connected to the P/S tip cooling channel 15 to discharge cooling air for cooling the external surface of the P/S tip rail. A row of P/S squealer pocket cooling holes 22 is also connected to the P/S tip cooling channels. The tip floor cooling channels 17 and 18 have sharp turns down at the ends so that impingement cooling of the tip rail section will be produced as the cooling air turns down and flows into the collection cavity 19.

Figure 3:
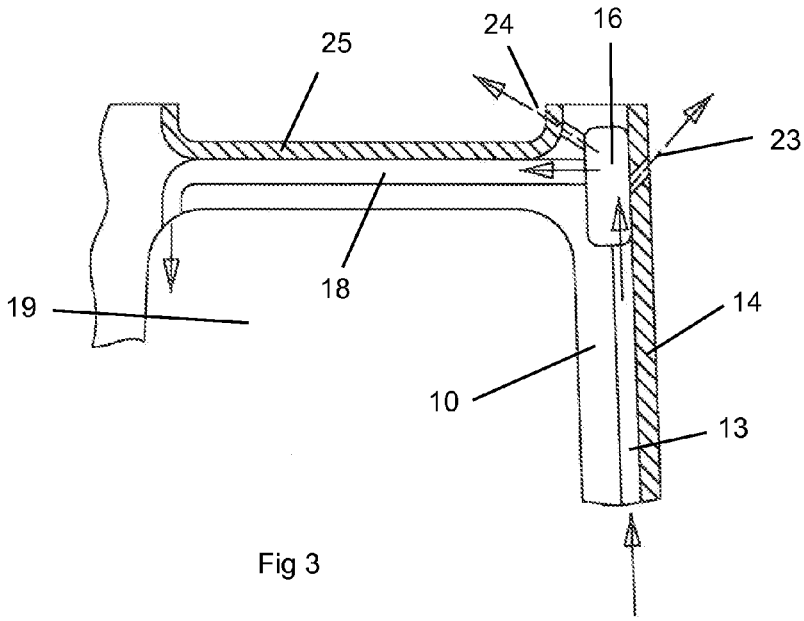
FIG. 3 shows a close-up view of the suction side tip cooling circuit of FIG. 1.

The suction side tip cooling channel 16 in FIG. 3 is connected to the S/S radial cooling channels 13 and to a series of second tip floor cooling channels 18 that also discharge into the cooling air collection cavity 19. The P/S tip floor cooling channels 17 and S/S tip floor cooling channels alternate between each other and provide cooling for the tip floor within the squealer pocket before discharging the spent cooling air into the common cooling air collection cavity 19. The S/S tip cooling channel 16 also includes a row of film cooling holes 23 and a row of squealer pocket cooling holes 24.

Figure 4:
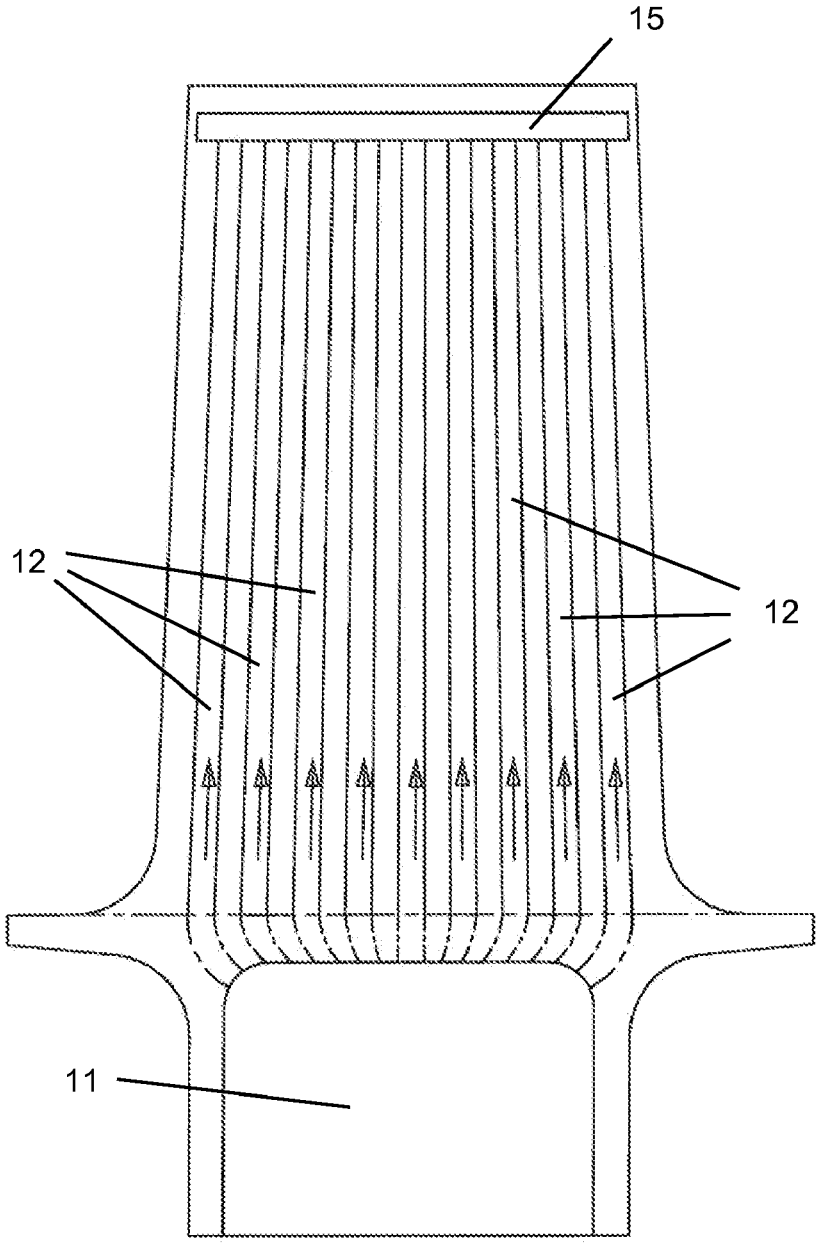
FIG. 4 shows a side view of the pressure side surface of the spar with the radial cooling channels and tip edge cooling channel of the blade of the present invention.

FIG. 4 shows the outer surface of the spar on the pressure wall side (without the thin thermal skin) with the cooling air supply cavity 11 and the P/S radial cooling channels 15 formed on the spar outer surface that discharge into the P/S tip cooling channel 15. The S/S surface of the spar is formed similarly with the radial channels discharging into the S/S tip cooling channel 16.

The blade of the present invention can be formed by casting the spar using the investment casting process with Nickel alloys. The radial cooling channels and the tip cooling channels can be formed during the casting process or machined into the spar after the casting process. also with the tip floor cooling channels. The radial channels and the tip cooling channels and the tip floor cooling channels can then be enclosed with the thin thermal skin material using a process such as the transient liquid phase (TLP) process. The film cooling holes and the squealer pocket cooling holes can be machined into the thermal skin after is has been bonded to the spar using an EDM process. Also with the trailing edge exit holes or slots.

In operation, fresh cooling air is supplied from an outside source to the cooling air supply cavity 11, and then passes through the radial cooling passages 12 and 13 formed on both the P/S and S/S of the blade to provide cooling first to the airfoil walls formed by the thin thermal skin 14. The cooling air from the radial cooling passages 12 and 13 then pass into the respective tip rail cooling channels 15 and 16 that will discharge some of the cooling air through the film cooling holes 21 and 23 and the squealer pocket cooling holes 22 and 24. The remaining cooling air from the tip cooling channels 15 and 16 will then flow through the respective tip floor cooling channels 17 and 18 with the P/S tip cooling channels 17 flowing toward the S/S wall and the S/S tip cooling channels 16 flowing toward the P/S wall in alternating fashion. This cools the tip floor of the squealer pocket with cooling air that has already been heated. The spent cooling air from the tip floor cooling channels 17 and 18 is then discharged into the cooling air collection cavity 19 and then discharged from the blade through a row of exit holes or slots formed on or around the trailing edge of the blade to provide cooling for the T/E region.

I claim the following:

1. A turbine rotor blade comprising:

an airfoil with a pressure side wall and a suction side wall;

a plurality of radial extending cooling channels formed in the pressure side wall and extending from a root of the blade to a blade tip;

a pressure side tip edge cooling channel extending from a leading edge region to a trailing edge region along the pressure side tip of the blade;

a plurality of tip floor cooling channels connected to the pressure side tip edge cooling channel and extending to near a suction side tip rail of the blade;

a cooling air collection cavity formed between the pressure side wall and the suction side wall; and, the plurality of tip floor cooling channels connected to the cooling air collection cavity.

2. The turbine rotor blade of claim 1, and further comprising:

the tip floor cooling channels extend along most of the tip floor of the blade.

3. The turbine rotor blade of claim 1, and further comprising:

a pressure side tip rail and a suction side tip rail forming a squealer pocket.

4. The turbine rotor blade of claim 3, and further comprising:

a row of cooling holes connected to the pressure side tip edge cooling channel and directed to discharge cooling air into the squealer pocket.

5. The turbine rotor blade of claim 3, and further comprising:

a thin thermal skin bonded to the squealer pocket and enclosing the pressure side tip floor cooling channels formed on an outer surface of the tip.

6. The turbine rotor blade of claim 1, and further comprising:

a row of film cooling holes connected to the pressure side tip edge cooling channel and directed to discharge cooling air upward.

7. The turbine rotor blade of claim 1, and further comprising:

the blade includes a spar having an airfoil shape with a thin thermal skin bonded over the spar to form the airfoil surface; and, the thin thermal skin encloses the radial extending cooling channels formed on an outer surface of the spar.

8. The turbine rotor blade of claim 1, and further comprising:

a row of cooling air exit holes along the trailing edge of the blade and connected to the cooling air collection cavity.

9. A turbine rotor blade comprising:

a spar having a pressure side surface and a suction side surface and a root with a cooling air supply cavity;

the spar having a pressure side tip cooling channel and a suction side tip cooling channel;

the spar having a row of radial extending cooling air channels formed on the pressure side surface and the suction side surface that are connected to the cooling air supply cavity;

the radial extending cooling air channels on the pressure side are connected to the tip cooling channel on the pressure side;

the radial extending cooling air channels on the suction side are connected to the tip cooling channel on the suction side;

a first row of tip floor cooling channels connected to the pressure side tip cooling channel;

a second row of tip floor cooling channels connected to the suction side tip cooling channel;

a thin thermal skin bonded to the spar and enclosing the radial cooling channels and the tip floor cooling channels;

a first row of film cooling holes connected to the pressure side tip cooling channel to discharge film cooling air;

the first and second rows of tip floor cooling channels are connected to the cooling air collection cavity; and, a row of trailing edge exit holes connected to the cooling air collection cavity.

10. The turbine rotor blade of claim 9, and further comprising:

the pressure side tip floor cooling holes and the suction side tip floor cooling holes alternate from one to the other across the tip floor.

11. The turbine rotor blade of claim 9, and further comprising:

the tip cooling channels are connected to cooling holes that open into the squealer pocket along the pressure side and suction side tip rails.

12. A process for cooling a turbine rotor blade, the blade comprising an airfoil with a pressure side wall and a suction side wall, a squealer pocket formed by a pressure side tip rail and a suction side tip rail, and a root having a cooling air supply cavity, and the airfoil walls forming a cooling air collection cavity, the process comprising the steps of:

supplying cooling air to the cooling air supply cavity;

passing the cooling air from the cooling air supply cavity up along the pressure side and suction side walls of the airfoil;

impinging the cooling air flowing along the walls to provide impingement cooling to the tip rails;

discharging some of the cooling air from the tip rails onto an external surface of the tip rails;

passing the cooling air from the tip rails along the tip floor to produce convection cooling of the tip floor;

passing the cooling air from the tip floor into the cooling air collection cavity; and, discharging the cooling air out through a trailing edge region of the blade to provide cooling for the trailing edge region.

13. The process for cooling a turbine rotor blade of claim 12, and further comprising the step of:

the step of passing the cooling air form the tip rails along the tip floor to produce convection cooling of the tip floor includes passing the cooling air in an alternating manner from the pressure side tip rail cooling channel and the suction side tip rail cooling channel.

14. The process for cooling a turbine rotor blade of claim 12, and further comprising the step of:

discharging some of the cooling air from the tip rails into the squealer pocket.

* * * * *